US005938487A

United States Patent [19]

Henry et al.

[11] Patent Number: 5,938,487

[45] Date of Patent: Aug. 17, 1999

[54] SOCKET CONTACT HAVING TAPERED BEAM

[75] Inventors: Randall Robert Henry; Robert Todd Frederick, both of Harrisburg, Pa.

[73] Assignee: The Whitaker Corporation, Wilmington, Del.

[21] Appl. No.: 09/067,736

[22] Filed: Apr. 28, 1998

Related U.S. Application Data

[63] Continuation-in-part of application No. 08/824,225, Mar. 25, 1997, abandoned.

[51] Int. Cl.[6] ..... H01R 13/00

[52] U.S. Cl. ..... 439/857; 439/851

[58] Field of Search ..... 439/857, 856, 439/851, 852

[56] References Cited

U.S. PATENT DOCUMENTS

| | | | |
|---|---|---|---|
| 2,689,337 | 9/1954 | Burtt et al. | 439/851 |
| 4,359,258 | 11/1982 | Palecek et al. | 439/851 |
| 4,734,064 | 3/1988 | Knapp et al. | 439/852 |
| 4,837,927 | 6/1989 | Savage, Jr. | 29/839 |
| 5,067,916 | 11/1991 | Denlinger et al. | 439/857 |
| 5,362,244 | 11/1994 | Hanson et al. | 439/82 |
| 5,376,012 | 12/1994 | Clark | 439/80 |
| 5,662,503 | 9/1997 | Castaldo | 439/857 |
| 5,766,045 | 6/1998 | Sawaki et al. | 439/857 |

*Primary Examiner*—Paula Bradley
*Assistant Examiner*—Tho D. Ta
*Attorney, Agent, or Firm*—Robert Kapalka

[57] ABSTRACT

A socket contact has a generally tubular base defining a longitudinal axis and beams extending from the base at spaced-apart locations around the base. The beams converge to define a pin reception zone between the beams. At least one of the beams has a tapered portion which progressively narrows as the beam extends longitudinally from the base, and a non-tapered portion having a lateral dimension which remains constant as the beam extends longitudinally. The length of the tapered portion and the degree of taper can be selected to provide desirable spring characteristics for the beam.

7 Claims, 2 Drawing Sheets

SOCKET CONTACT HAVING TAPERED BEAM

REFERENCE TO RELATED APPLICATIONS

This application is a continuation-in-part of application Ser. No. 08/824,225 filed Mar. 25, 1997 now abandoned.

FIELD OF THE INVENTION

The invention relates to a socket-type electrical contact having a resilient contact beam.

BACKGROUND OF THE INVENTION

Socket contacts are known for mating with a pin contact of an electrical device. Some known socket contacts have a body with a generally tubular base and contact beams which extend from the base at circumferentially spaced-apart locations around the base. The beams converge for mating engagement with a pin contact which is inserted along an axis between the beams. These socket contacts may be made by stamping and forming, drawing, or screw machine methods, but in all cases, material is removed from the body to define the spaced-apart contact beams.

A socket contact for use with coaxial cable is required to mate with different center conductors that can have large variations in diameter. Previously, a known socket contact sold by AMP Incorporated of Harrisburg, Pa. has been made from a beryllium-copper material that provides resiliency and spring characteristics required for mating with conductors over a wide range of sizes. A problem exists in that the beryllium-copper material is relatively expensive, thereby making the socket contact expensive to produce. Further, this socket contact is required to fit in a small dimensional envelope, so the contact beams are relatively short and fragile. This limits the amount of deflection which the contact beams can accept before they are damaged by overstress.

Another problem exists for a socket contact having beams which may be-plated with either tin or gold. The tin-plated beams must exert a greater normal force on a mating pin contact than the gold-plated beams. U.S. Pat. No. 5,067,916 discloses a socket contact having tapered beams, and the degree of taper is selected in accordance with the plating on the beams to provide a desired normal force on the mating pin contact. However, this socket contact can only accommodate a pin contact having a specific diameter, and multiple socket contacts having beams with different tapers are needed to accommodate a range of pin diameters.

There is a need for a socket contact which will permit use of a different, less expensive material while maintaining the ability to accommodate mating pin contacts in a wide range of sizes.

SUMMARY OF THE INVENTION

The invention is a socket contact comprising a socket body including a generally tubular base defining a longitudinal axis and beams extending from the base at spaced-apart locations around the base. The beams converge to define a pin reception zone between the beams. At least one of the beams has a tapered portion which progressively narrows as the beam extends longitudinally, and a non-tapered portion having a lateral dimension which remains constant as the beam extends longitudinally. The longitudinal extent of the tapered portion and the degree of taper can be selected to provide desirable spring characteristics for the beam.

BRIEF DESCRIPTION OF THE DRAWINGS

The invention will now be described by way of example with reference to the accompanying drawings wherein.

DETAILED DESCRIPTION OF AN EMBODIMENT OF THE INVENTION

Figure 1:
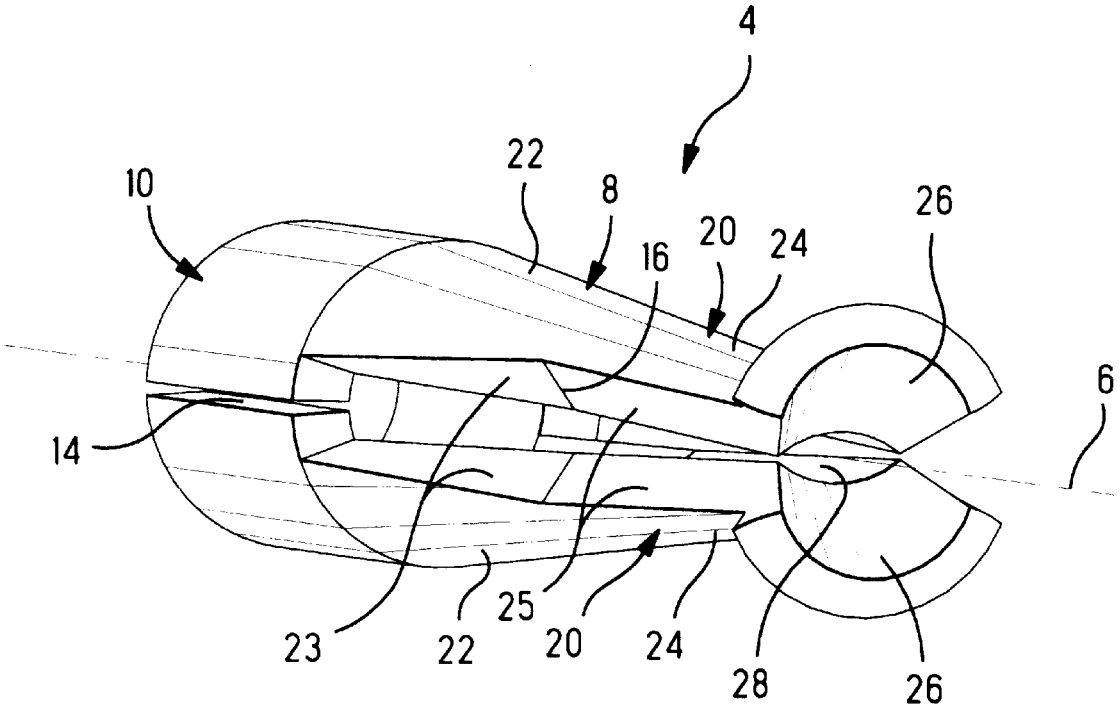
FIG. 1 is a left front isometric view of a socket contact according to the invention.
Figure 2:
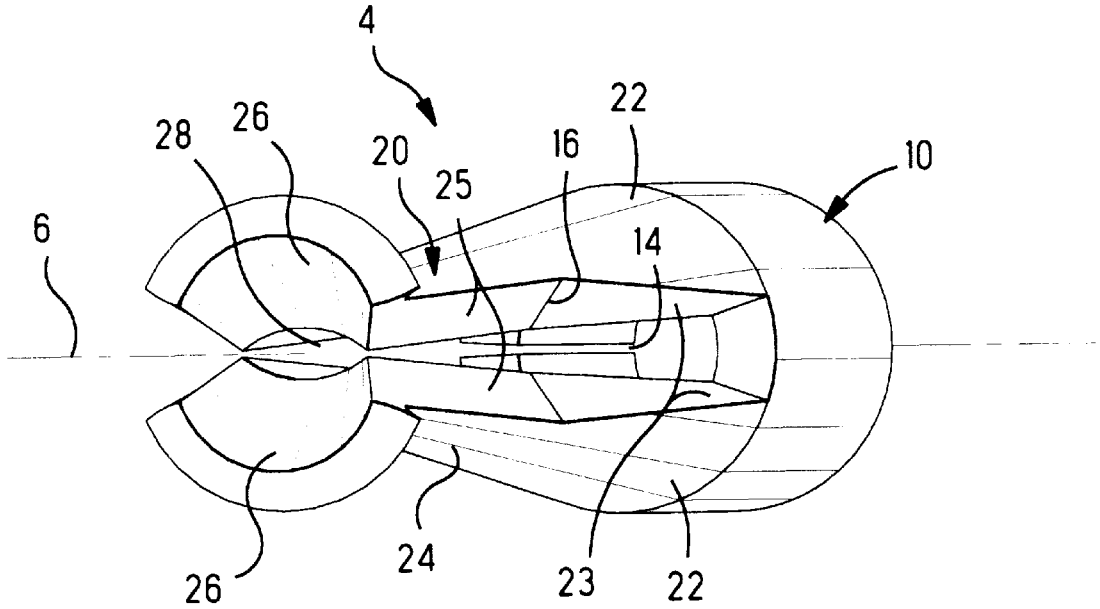
FIG. 2 is a right front isometric view of the socket contact.

There is shown in FIGS. 1 and 2 a socket contact according to the invention comprising an electrically conductive body 4 which is generally tubular along a longitudinal axis 6. The body 4 has at least one longitudinally extending beam 8 which converges toward the axis 6 for engaging a pin contact (not shown) that is inserted into the body 4 along the axis 6. The beam 8 has a portion which tapers in dimension as the beam extends longitudinally. More particularly, a lateral dimension of the beam is tapered, i.e., progessively narrowed, as the beam extends along the longitudinal axis 6. The taper of the beam 8 affects the spring characteristics of the beam. By appropriate selection of the length of the tapered portion and the degree of taper, desired spring characteristics can be obtained for the beam when the body 4 is made of a specified material.

In the particular embodiment shown, the body 4 includes a generally tubular base 10 and a pair of resilient contact beams 20 which extend from the base 10 at spaced-apart locations around the base. The base 10 has a longitudinal axis which is the same as the longitudinal axis 6 of the body 4. The beams 20 converge toward the axis 6 and define a pin reception zone 28 therebetween.

Each of the contact beams 20 includes a tapered portion 22, a non-tapered portion 24, and a guide portion 26. Each of the tapered portions 22 has a pair of side edges 23, and each of the non-tapered portions 24 has a pair of side edges 25. The side edges 23, 25 intersect at junction 16 and are angled with respect to each other. The tapered portion 22 and the non-tapered portion 24 are distinguished by their respective geometries which are defined by the angularity of their respective side edges 23, 25.

Figure 6:
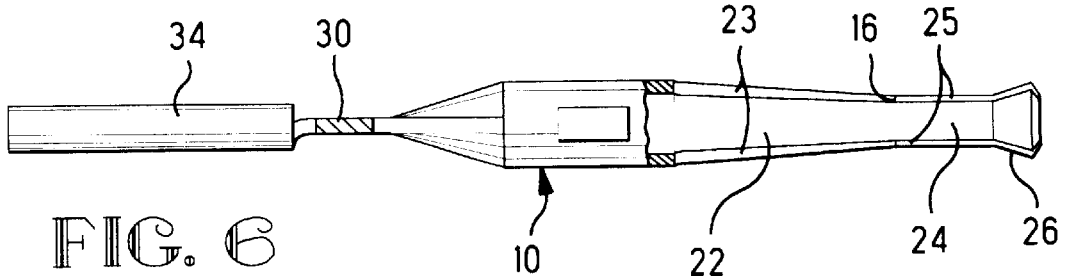
FIG. 6 is a partial cross-sectional view showing an interior of the socket contact from the perspective of FIG. 5.

As best seen in FIG. 6, the side edges 23 of the tapered portion 22 converge as they extend from the base 10 toward the non-tapered portion 24. That is, the tapered portion 22 has a lateral dimension which progressively narrows as the tapered portion extends longitudinally. Moreover, since the socket contact has a generally tubular shape, an arcuate dimension between the pair of side edges 23 defines an included angle which progressively narrows as the tapered portion extends longitudinally from the base 10 to the non-tapered portion 24.

The contact beam converts from a tapered beam to a non-tapered beam at the junction 16. The length of the tapered portion 22 is limited so that the tapered portion can have a significant degree of taper without becoming unduly narrow and fragile.

The side edges 25 of the non-tapered portion 24 are parallel as they extend from the tapered portion 22 to the guide portion 26. That is, the non-tapered portion 24 has a lateral dimension which remains constant as the non-tapered portion extends longitudinally. Further, an arcuate dimension between the pair of side edges 25 defines an included angle which remains constant as the non-tapered portion extends longitudinally from the tapered portion 22 to the guide portion 26.

The guide portions 26 are mutually angled to form a funneled inlet which guides a mating pin contact into alignment with the axis 6 and into the pin reception zone 28. A mating pin contact which enters the pin reception zone is engaged between the contact beams 20.

Although the socket contact is shown as having a pair of contact beams 20 that are mutually opposed on opposite sides of the axis 6, other arrangements and quantities of the contact beams 20 are also possible and are considered to be within the scope of the invention.

Figure 3:
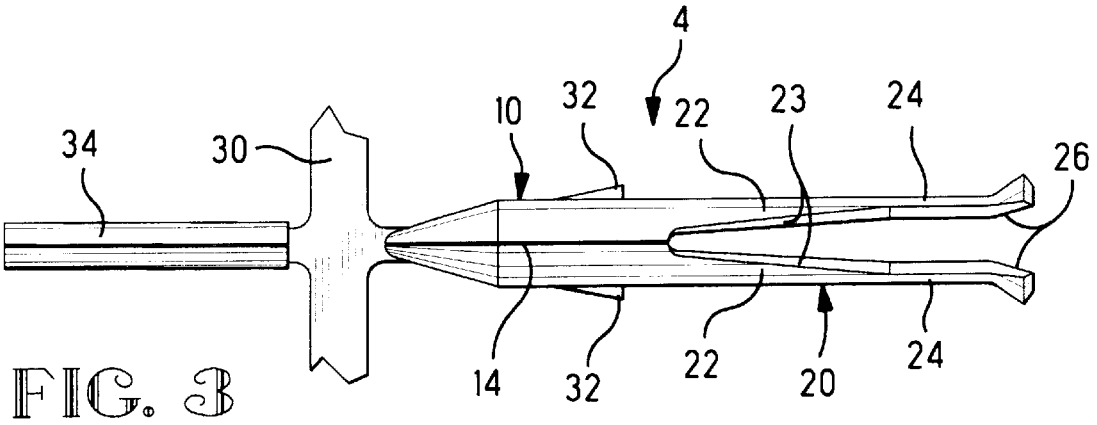
FIG. 3 is a top view of the socket contact partially formed on a carrier strip.
Figure 4:
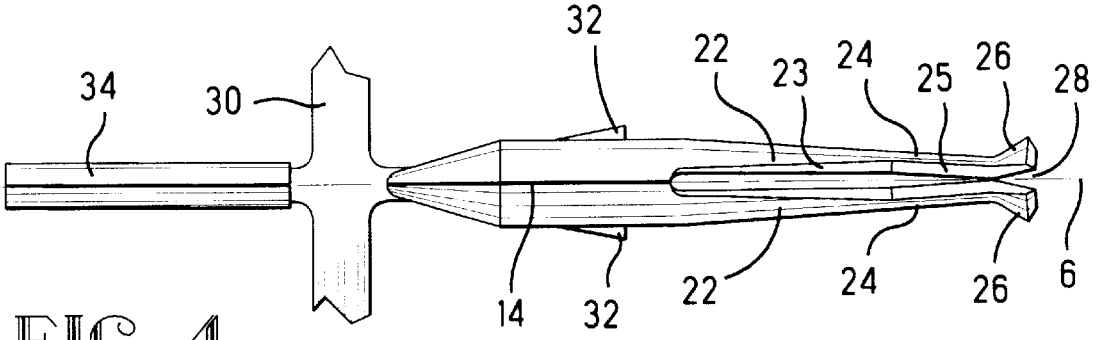
FIG. 4 is a top view of the socket contact fully formed on a carrier strip.
Figure 5:
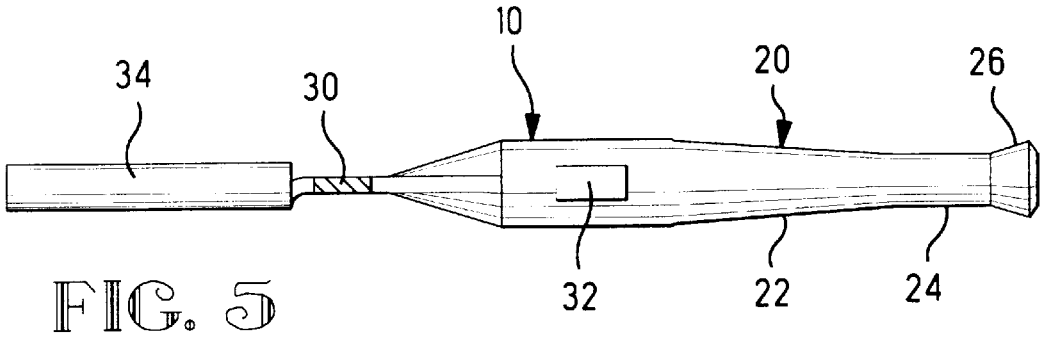
FIG. 5 is a side view of the socket contact of FIG. 4.

With reference to FIGS. 3–5, a socket body 4 may be made by stamping and forming a section of sheet material which is attached to a carrier strip 30. Initially, portions of the sheet material are removed to define the edges 23, 25 of the contact beams 20. Then, the sheet material is bent into a generally tubular shape. As can be ascertained from FIG. 3, wedge-shaped portions of the sheet material have been removed between the side edges 23, and rectangular-shaped portions of the sheet material have been removed between the side edges 25. This differs from the prior art wherein either rectangular portions or wedge-shaped portions of sheet material are removed, but not both in a single contact.

As shown in FIG. 4, the beams 20 have been bent so that they converge toward the pin reception zone 28. After forming, the socket body 4 is left with a seam 14 between opposed edges of the sheet material.

The socket contact 4 can be formed with lances 32 which are engageable with walls of a housing to hold the socket contact in the housing. The socket contact can also have a tail 34 which is insertable into a plated through-hole in a circuit board. The tail 34 may have a cylindrical cross-section and may be bent to extend at any desired angle with respect to the axis 6 of the socket body 4.

A socket contact according to the invention may also be made by other methods including drawing and screw machining.

The invention provides a socket contact having at least one contact beam which includes a tapered portion and a non-tapered portion. The tapered portion permits the contact beam to undergo a greater deflection without being overstressed. The non-tapered portion provides an adequate width for the contact beam to guide and contain a mating pin contact. The combination of tapered and non-tapered portions permits the contact beam to have desirable spring characteristics without having to resort to expensive materials for the contact. In particular, the combination of tapered and non-tapered portions enables the contact beam to have sufficient spring force at small deflections to ensure a reliable electrical connection with a mating pin contact, while also permitting the contact beam to undergo relatively large deflections without being overstressed. Therefore, a socket contact which is restricted to a small dimensional envelope can accommodate a wide range of contact pin diameters while also being economical to manufacture.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. A socket contact comprising:

a generally tubular body defining a longitudinal axis, the body having a longitudinally extending beam which converges toward the axis to define a pin reception zone where there is minimum separation between the beam and the axis, wherein a pin contact that is inserted along the axis is engaged by the beam at the pin reception zone, the beam including a tapered portion having a lateral dimension which progressively narrows as the beam extends longitudinally toward the pin reception zone, and a non-tapered portion having a lateral dimension which remains constant as the beam extends longitudinally from the tapered portion to the pin reception zone.

2. A socket contact comprising:

a socket body including a generally tubular base defining a longitudinal axis and beams extending from the base at spaced-apart locations around the base, the beams converging to define a pin reception zone where there is minimum separation between the beams, at least one of the beams including a tapered portion having a lateral dimension which progressively narrows as the beam extends longitudinally from the base, and a non-tapered portion having a lateral dimension which remains constant as the beam extends longitudinally from the tapered portion to the pin reception zone.

3. The socket contact according to claim 2, wherein the socket body includes a mutually opposed pair of said at least one beam.

4. The socket contact according to claim 3, wherein the beams have free ends that are angled for guiding a pin contact into the pin reception zone.

5. A socket contact comprising:

a socket body including a base and beams extending from the base at spaced-apart locations around the base, the beams converging toward a pin-receiving axis for engaging a pin contact that is inserted along the axis, the beams defining a pin reception zone where there is minimum separation between the beams, at least one of the beams including a tapered portion having an included angle which tapers as the beam extends longitudinally from the base, and a non-tapered portion having an included angle which remains constant as the beam extends longitudinally from the tapered portion to the pin reception zone.

6. The socket contact according to claim 5, wherein the socket body includes a mutually opposed pair of said at least one beam.

7. The socket contact according to claim 6, wherein the beams have free ends that are angled for aligning the pin contact with the pin-receiving axis.

* * * * *